US007708537B2

(12) United States Patent
Bhatia et al.

(10) Patent No.: US 7,708,537 B2
(45) Date of Patent: May 4, 2010

(54) FLUID SEPARATOR FOR A COMPRESSOR

(75) Inventors: Kanwal Bhatia, Canton, MI (US); Michael Gregory Theodore, Jr., Plymouth, MI (US)

(73) Assignee: Visteon Global Technologies, Inc., Van Buren Township, MI (US)

( * ) Notice: Subject to any disclaimer, the term of this patent is extended or adjusted under 35 U.S.C. 154(b) by 167 days.

(21) Appl. No.: 11/970,227

(22) Filed: Jan. 7, 2008

(65) Prior Publication Data

US 2009/0173095 A1 Jul. 9, 2009

(51) Int. Cl.
*F04C 29/02* (2006.01)
*B01D 45/12* (2006.01)
*B01D 50/00* (2006.01)

(52) U.S. Cl. ..... 418/55.6; 418/270; 418/DIG. 1; 210/512.1; 210/787

(58) Field of Classification Search ..... 418/83, 418/55.1, 55.6, 58, 60, 89, 97, 99, 100, DIG. 1, 418/270; 210/512.1, 787–789
See application file for complete search history.

(56) References Cited

U.S. PATENT DOCUMENTS

| | | | | |
|---|---|---|---|---|
| 4,767,293 | A | 8/1988 | Caillat et al. | |
| 6,179,578 | B1 * | 1/2001 | Kayukawa et al. | 417/313 |
| 6,475,256 | B2 * | 11/2002 | Matsubara et al. | 55/337 |
| 6,543,243 | B2 | 4/2003 | Mohrmann et al. | |
| 6,554,595 | B2 * | 4/2003 | Hida et al. | 418/DIG. 1 |
| 6,558,133 | B2 * | 5/2003 | Fukanuma et al. | 417/222.2 |
| 6,715,995 | B2 | 4/2004 | Kelm et al. | |
| 6,742,350 | B2 | 6/2004 | Suzuki et al. | |
| 6,786,055 | B2 | 9/2004 | Inoue et al. | |
| 6,802,187 | B2 | 10/2004 | Kawahara | |
| 6,874,328 | B2 | 4/2005 | Suzuki et al. | |
| 7,021,902 | B2 | 4/2006 | Terauchi | |
| 7,076,963 | B2 | 7/2006 | Higashiyama | |
| 7,255,543 | B2 | 8/2007 | Yokoyama | |
| 7,264,453 | B2 | 9/2007 | Gennami et al. | |
| 2003/0053916 | A1 | 3/2003 | Terauchi | |
| 2003/0101740 | A1 | 6/2003 | Suzuki et al. | |
| 2003/0152467 | A1 | 8/2003 | Higashiyama et al. | |
| 2004/0231349 | A1 | 11/2004 | Ikura et al. | |
| 2004/0265143 | A1 | 12/2004 | Kawahara et al. | |
| 2005/0129536 | A1 | 6/2005 | Ohtake | |
| 2005/0129556 | A1 | 6/2005 | Ito | |
| 2005/0226756 | A1 | 10/2005 | Ito | |
| 2005/0265878 | A1 | 12/2005 | Ishida | |
| 2005/0268632 | A1 | 12/2005 | Yonekura et al. | |
| 2006/0196221 | A1 | 9/2006 | Westermeyer | |

(Continued)

FOREIGN PATENT DOCUMENTS

| | | | |
|---|---|---|---|
| EP | 1 285 791 | A1 | 2/2003 |

(Continued)

*Primary Examiner*—Thomas E Denion
*Assistant Examiner*—Mary A Davis
(74) *Attorney, Agent, or Firm*—Fraser Clemens Martin & Miller LLC; J. Douglas Miller

(57) ABSTRACT

A fluid separator for a compressor is disclosed including a hollow main body having an annular flange and an annular collar formed thereon, wherein the annular collar includes an annular array of apertures formed therein for separating a liquid from a fluid and attenuating pressure pulsations of the fluid.

20 Claims, 2 Drawing Sheets

U.S. PATENT DOCUMENTS

| | | | | |
|---|---|---|---|---|
| 2007/0175239 | A1 | 8/2007 | Inoue | |
| 2008/0101974 | A1* | 5/2008 | Ro | 418/55.6 |
| 2008/0226483 | A1* | 9/2008 | Iwanami et al. | 418/97 |

FOREIGN PATENT DOCUMENTS

| | | | |
|---|---|---|---|
| EP | 1 293 676 | A2 | 3/2003 |
| EP | 0 285 791 | B1 | 8/2004 |
| JP | 2004084662 | A | 3/2004 |
| JP | 2007064052 | A | 3/2007 |

* cited by examiner

FLUID SEPARATOR FOR A COMPRESSOR

FIELD OF THE INVENTION

The invention relates to a compressor and more particularly to a fluid separator having an annular array of apertures formed therein adapted to separate a liquid from a fluid and attenuate pressure pulsations of the fluid.

BACKGROUND OF THE INVENTION

Hybrid electric vehicles having improved fuel economy over internal combustion engine and other vehicles are quickly becoming more popular as a cost of traditional fuel increases. Typically, the improved fuel economy is due to known technologies such as regenerative braking, electric motor assist, and engine-off operation.

Although the technologies improve fuel economy, there are drawbacks. One such drawback is that accessories powered by a fuel-powered engine no longer operate when the fuel-powered engine is not in operation. One major accessory that does not operate is an air-conditioning compressor, which cools air in a passenger compartment of the vehicle. Ultimately, without the use of the compressor, a temperature of the air in the passenger compartment increases to a point above a desired temperature and the fuel-powered engine of the vehicle must restart.

Accordingly, vehicle manufacturers have used a full electric compressor on hybrid vehicles. The full electric compressor operates whether the fuel-powered engine is operating or not. A significant disadvantage of the full electric compressor is the inefficiency that occurs from converting engine shaft power to electricity, then electricity back to compressor shaft power. Thus, the use of a hybrid compressor which is mechanically and electrically driven is advantageous. One such hybrid compressor is a dual drive scroll compressor described in U.S. Pat. No. 6,543,243 entitled HYBRID COMPRESSOR, hereby incorporated herein by reference in its entirety.

In order to achieve high reliability and long life of the compressor, oil is used for lubrication to minimize a wear of internal components of the compressor. In addition to lubricating the compressor, the oil also carries away heat and performs a sealing function, particularly between mating surfaces.

The oil is typically stored in an oil reservoir disposed in the compressor, and transported in the compressor unit with a refrigerant. However, it is desirable that the oil contained in the refrigerant be separated before leaving a housing of the compressor, so that the oil may flow back into the oil reservoir. Prior art oil separators, such as cyclone separators, which include filtering means and spaces to reduce the velocity of flow, are known in the art.

U.S. Pat. No. 6,874,328 entitled HYBRID COMPRESSOR DEVICE, hereby incorporated herein by reference in its entirety, discloses an oil separating unit. The oil separating unit is a funnel-shaped member adapted to cause a swirling movement of a refrigerant. Such swirling movement applies a centrifugal force to a lubricating oil contained in the refrigerant, thereby separating the lubricating oil from the refrigerant. An outer periphery of the funnel-shaped member contacts an inner wall of an oil storage chamber and is affixed thereto.

U.S. Pat. No. 7,264,453 entitled HORIZONTAL SCROLL COMPRESSOR HAVING A CONNECTING PASSAGE ON THE OPPOSITE SIDE OF A SUCTION PORT FOR CONNECTING A MOTOR ACCOMMODATING CHAMBER WITH A SUCTION CHAMBER, hereby incorporated herein by reference in its entirety, discloses an oil separator for separating a lubricating oil from a high pressure refrigerant gas. The oil separator is a hollow member having a passageway formed therethrough. The passageway facilitates the flow of the high pressure refrigerant gas to a discharge port. The oil separator is disposed in a discharge chamber of a compressor, wherein the discharge chamber includes a reservoir to accumulate the separated lubricating oil.

It is also desirable that during operation of the compressor, a noise generated thereby which is perceptible by passengers of the vehicle is minimized. Operating noise is primarily caused by pressure pulsations associated with compression. In practice, different structures are used for reducing the pressure pulsations, such as chambers where pressure waves are attenuated by expansion.

U.S. Patent Application Publication No. 2007/0175239 entitled REFRIGERANT COMPRESSOR, hereby incorporated herein by reference in its entirety, discloses a compressor having an oil separation structure. The separation structure includes a plurality of separation chambers for separating a lubricating oil from a refrigerant gas. The separation chambers are in fluid communication with a muffler chamber. An expansion type muffler effect of the muffler chamber attenuates variation in pressure waves of the refrigerant gas.

Although the aforementioned structures operate effectively, the structures involve higher manufacturing costs. Additionally, the structures are complex, heavy, and are difficult to package in small engine bays of hybrid vehicles.

Accordingly, it would be desirable to produce a fluid separator for a compressor, wherein an attenuation of pressure pulsations and a separation of a fluid flowing therethrough are maximized and a cost, complexity, and space requirement thereof are minimized.

SUMMARY OF THE INVENTION

In concordance and agreement with the present invention, a fluid separator for a compressor, wherein an attenuation of pressure pulsations and a separation of a fluid flowing therethrough are maximized and a cost, complexity, and space requirement thereof are minimized, has surprisingly been discovered.

In one embodiment, the fluid separator for a compressor comprises a hollow main body having an inlet end and an outlet end; a flange formed on the outlet end of the hollow main body; and a collar formed on the hollow main body intermediate the inlet end and the outlet end, the collar having at least one aperture formed therein, wherein the at least one aperture facilitates a separation of a liquid from a fluid.

In another embodiment, the compressor comprises a housing including a chamber formed therein, the chamber having an inner surface; and a fluid separator disposed in the chamber, the fluid separator further comprising: a hollow main body including an inlet end and an outlet end; an annular flange formed on the outlet end of the hollow main body, the annular flange having an outer surface, wherein the outer surface is adapted to abut the inner surface of the chamber to form a substantially fluid-tight seal therebetween; and an annular collar formed on the hollow main body intermediate the inlet end and the outlet end, the annular collar having an outer surface and an annular array of apertures formed therein, wherein the outer surface is adapted to abut the inner surface of the chamber to form a substantially fluid-tight seal therebetween, and wherein the apertures are adapted to separate a liquid from a fluid.

In another embodiment, the hybrid compressor comprises a housing forming a hollow interior, the housing including a chamber having an inner surface, wherein the chamber includes an inlet, a first outlet, and a second outlet; a plurality of compression assemblies disposed in the hollow interior of the housing, one of the compression assemblies driven by a mechanical source, and another of the compression assemblies driven by an electrical source; and an oil separator disposed in the chamber, wherein the oil separator divides the chamber into a first sub-chamber, a second sub-chamber, and a third sub-chamber, wherein the first sub-chamber is in fluid communication with the first outlet and the third sub-chamber, the second sub-chamber is in fluid communication with the inlet and the third sub-chamber, and the third sub-chamber is in fluid communication with the second sub-chamber and the second outlet, the oil separator further comprising: a hollow main body including an inlet end and an outlet end, wherein the hollow main body is adapted to facilitate a flow of a refrigerant from the third sub-chamber to the first sub-chamber; an annular flange formed on the outlet end of the hollow main body, the annular flange having an outer surface, wherein the outer surface is adapted to abut the inner surface of the chamber to form a substantially fluid-tight seal therebetween; and an annular collar formed on the hollow main body intermediate the inlet end and the outlet end, the annular collar having an outer surface and an annular array of apertures formed therein, wherein the outer surface is adapted to abut the inner surface of the chamber to form a substantially fluid-tight seal therebetween, and wherein the apertures are adapted to separate an oil from a refrigerant.

Advantages of the above invention include a greater amount of oil returned to the compressor to ensure adequate sealing, less oil in the refrigeration system, increased muffling capability, and greater system reliability resulting from improved lubrication of the compressor.

BRIEF DESCRIPTION OF THE DRAWINGS

The above and other objects and advantages of the invention will become readily apparent to those skilled in the art from reading the following detailed description of the invention when considered in the light of the accompanying drawings, in which.

DETAILED DESCRIPTION OF THE PREFERRED EMBODIMENTS OF THE INVENTION

The following detailed description and appended drawings describe and illustrate an exemplary embodiment of the present invention. The description and drawings serve to enable one skilled in the art to make and use the invention, and are not intended to limit the scope of the invention in any manner. It is understood that materials other than those described can be used without departing from the scope and spirit of the invention.

Figure 1:
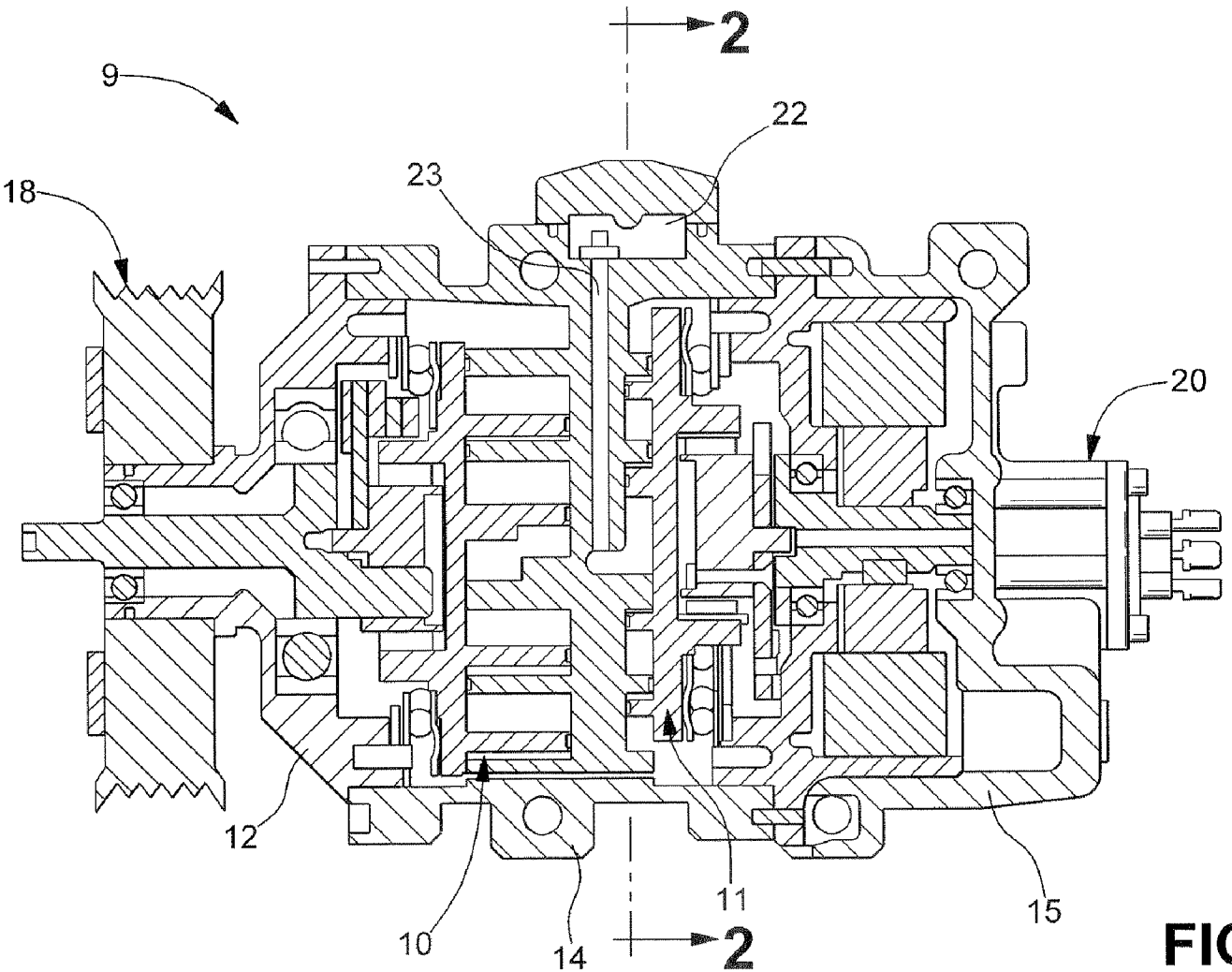
FIG. 1 is a cross-sectional view of a hybrid compressor according to an embodiment of the invention.

FIG. 1 shows a compressor 9 according to an embodiment of the invention. Although the compressor 9 in the embodiment shown is a hybrid scroll compressor, it is understood that the compressor 9 can be other compressor types if desired. In the embodiment shown, the compressor 9 includes a housing assembly having a first compression assembly 10 and a second compression assembly 11 disposed therein. The housing assembly includes a first housing shell 12, a second housing shell 14, and a third housing shell 15. The first housing shell 12, the second housing shell 14, and the third housing shell 15 cooperate to form a hollow interior. The housing shells 12, 14, 15 can be produced from any conventional material such as aluminum, for example. Although each of the housing shells 12, 14, 15 shown has a substantially circular cross-sectional shape, other cross-sectional shapes can be used as desired.

In the illustrated embodiment, the first compression assembly 10 is adapted to be driven by a mechanical source 18 such as a pulley system in mechanical communication with a fuel-powered engine of a vehicle, for example. The second compression assembly 11 is adapted to be driven by an electrical source 20 such as an electric motor, for example. It is understood that the compression assemblies 10, 11 can be driven by other sources as desired.

Figure 2:
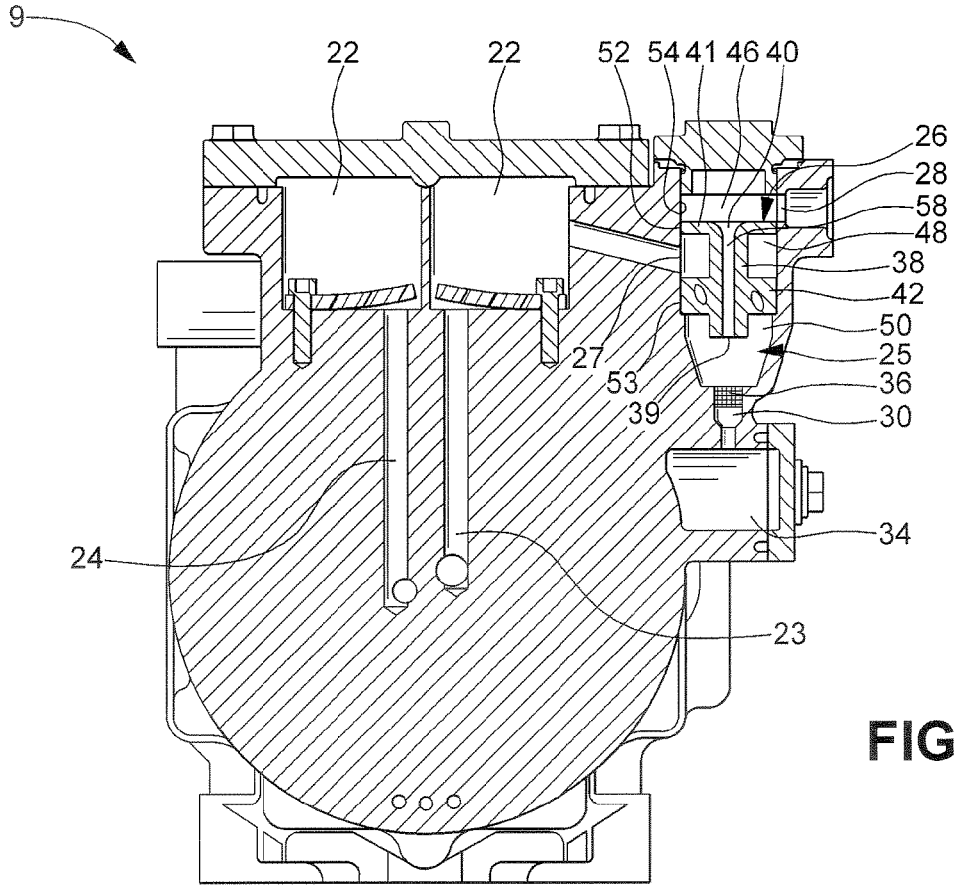
FIG. 2 is an enlarged cross-sectional view of the compressor illustrated in FIG. 1 taken along line 2-2.

Each of the compression assemblies 10, 11 is adapted to compress a fluid (not shown) containing a liquid (not shown) flowing therethrough. In the embodiment shown, the fluid is a refrigerant for use in a refrigeration system (not shown) such as a heating, ventilating, and air conditioning system for a vehicle, for example. The liquid is an oil for lubricating the compressor 9. It is understood that the fluid and the liquid can by any conventional fluid and liquid as desired. The compression assemblies 10, 11 are in fluid communication with at least one discharge chamber 22 formed in the housing assembly through respective discharge paths 23, 24 as shown in FIG. 2. The at least one discharge chamber 22 is adapted to receive the compressed fluid containing the liquid from the compression assemblies 10, 11. In the embodiment shown, the compressed fluid has a highly varying flow velocity, which results in pressure pulsations within the compressor 9.

As illustrated in FIG. 2, the housing assembly also includes a separation chamber 25. The separation chamber 25 is adapted to receive a fluid separator 26 therein. The fluid separator 26 is adapted to separate the liquid from the fluid. Although the separation chamber 25 illustrated has a generally cylindrical shape, it is understood that the separation chamber 25 may have other shapes as desired. The separation chamber 25 includes an inlet 27, a first outlet 28, and a second outlet 30. In the embodiment shown, the inlet 27 is in fluid communication with the at least one discharge chamber 22. The first outlet 28 is in fluid communication with the refrigeration system. The refrigeration system is adapted to circulate the fluid through a series of heat exchangers (not shown) and valves (not shown) back to the compressor 9. The second outlet 30 is in fluid communication with at least one suction chamber 34. The second outlet 30 has a diameter adapted to permit a desired amount of the liquid to flow into the at least one suction chamber 34. A screen 36 may be disposed in the second outlet 30 to filter the liquid and militate against debris and other foreign material from flowing into the at least one suction chamber 34. The at least one suction chamber 34 is adapted to receive the liquid from the separation chamber 25 and the fluid from the refrigeration system. The at least one suction chamber 34 is also in fluid communication with the compression assemblies 10, 11 through at least one suction inlet (not shown).

In the embodiment shown, the fluid separator 26 is produced from any conventional material such as aluminum, plastic, and brass, for example. The fluid separator 26 includes a hollow main body 38 having an inlet end 39 and an outlet end 40. The outlet end 40 includes an annular flange 41 formed thereon. An annular collar 42 is formed on the main body 38 intermediate the inlet end 39 and the outlet end 40.

The annular flange 41 and the annular collar 42 divide the separation chamber 25 into a first sub-chamber 46 adapted to receive the fluid therein, a second sub-chamber 48 adapted to receive the fluid containing the liquid therein, and a third sub-chamber 50 adapted to receive the separated liquid and the fluid therein. The first sub-chamber 46 is in fluid communication with the first outlet 28 and the third sub-chamber 50. The second sub-chamber 48 is in fluid communication with the inlet 27 and the third sub-chamber 50. The third sub-chamber 50 is in fluid communication with the first sub-chamber 46, the second sub-chamber 48, and the second outlet 30. An outer circumferential surface 52 of the annular flange 41 and an outer circumferential surface 53 of the annular collar 42 are adapted to sealingly abut an inner surface 54 of the separation chamber 25 to form a substantially fluid-tight seal therebetween.

Figure 3:
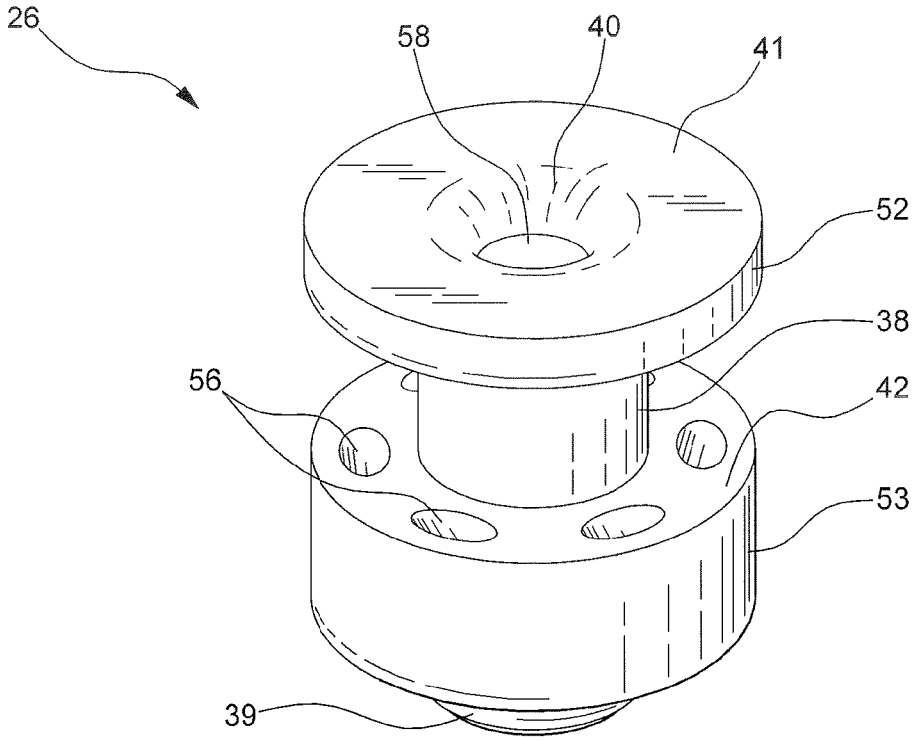
FIG. 3 is a perspective view of a fluid separator for the compressor illustrated in FIGS. 1 and 2.

As shown in FIG. 3, the annular collar 42 includes an annular array of apertures 56 formed therein. The apertures 56 extend diagonally through the annular collar 42 to cause a swirling movement and a centrifugation of the fluid, thereby separating the liquid from the fluid. The apertures 56 are also formed to cause the pressure pulsations of the fluid to be divided into smaller, separate pulses. In the embodiment shown, the apertures 56 are generally elliptical in shape, although it is understood that the apertures 56 can have other shapes as desired. It is also understood that the apertures 56 can have any diameter as desired.

The main body 38 of the fluid separator 26 also includes a passageway 58 formed therethrough. The passageway 58 is adapted to facilitate a flow of the fluid from the third sub-chamber 50 to the first sub-chamber 46. Although the passageway 58 in the embodiment shown has a substantially circular cross-sectional shape, it is understood that the passageway 58 can have other cross-sectional shapes as desired. It is also understood that the passageway 58 can be any diameter as desired.

In operation, the fluid containing the liquid flows at a high velocity from at least one of the compression assemblies 10, 11 through one of the discharge paths 23, 24 into the at least one discharge chamber 22. The fluid containing the liquid is then caused to flow from the at least one discharge chamber 22 through the inlet 27 into the second sub-chamber 48 of the separation chamber 25. In the second sub-chamber 48, the fluid containing the liquid expands causing a cooling and a reduction in a flow velocity thereof. A reflection of the pressure waves of the fluid containing the liquid within the second sub-chamber 48 causes an attenuation of the pressure pulsations. Accordingly, the second sub-chamber 48 functions as an expansion muffler.

The fluid containing the liquid is then caused to flow through the apertures 56 formed in the annular collar 42 into the third sub-chamber 50 of the separation chamber 25. The flow of the fluid containing the liquid through the apertures 56 causes a swirling movement thereof. The swirling movement applies a centrifugal force on the liquid contained in the fluid, thereby separating the liquid from the fluid. Moreover, the flow of the fluid through the apertures 56 further attenuates the pressure pulsations.

In the third sub-chamber 50, the fluid expands, causing a cooling and a further reduction in the flow velocity thereof. A reflection of the pressure waves of the fluid within the third sub-chamber 50 further causes an attenuation of the pressure pulsations. Accordingly, the third sub-chamber 50 also functions as an expansion muffler. In the embodiment shown, the separated liquid is then caused to flow along the inner surface 54 of the separation chamber 25 through the second outlet 30 into the at least one suction chamber 34 of the compressor 9. Simultaneously, the fluid is caused to flow from the third sub-chamber 50 through the passageway 58 into the first sub-chamber 46 of the separation chamber 25. The passageway 58 of the main body 38 of the fluid separator 26 also attenuates the pressure pulsations by a reflection of the pressure waves therewithin.

In the first sub-chamber 46, the fluid further expands, causing a cooling and a reduction in the flow velocity thereof. The pressure waves of the fluid are also reflected in the first sub-chamber, further attenuating the pressure pulsations. In the embodiment shown, the fluid is then discharged from the compressor 9 through the first outlet 28 into the refrigeration system.

Once in the at least one suction chamber 34 the separated liquid is combined with the fluid circulated back to the compressor 9 from the refrigeration system. The fluid containing the liquid is then introduced back into at least one of the compression assemblies 10, 11 through the at least one suction inlet. As the fluid containing the liquid flows through and is compressed by at least one of the compression assemblies 10, 11, heat generated thereby is absorbed and carried away by the liquid. Additionally, a portion of the liquid adheres to the compression assemblies 10, 11, resulting in a lubrication and a sealing thereof. The lubrication and the sealing of the compression assemblies 10, 11 militates against wear and damage thereto and a leakage therefrom.

From the foregoing description, one ordinarily skilled in the art can easily ascertain the essential characteristics of this invention and, without departing from the spirit and scope thereof, can make various changes and modifications to the invention to adapt it to various usages and conditions in accordance with the scope of the appended claims.

What is claimed is:

1. A fluid separator for a compressor comprising:

a hollow main body having an inlet end and an outlet end;

a flange formed on the outlet end of the hollow main body, the flange having an outer surface, wherein the outer surface abuts an inner surface of a chamber to form a substantially fluid-tight seal therebetween; and a collar formed on the hollow main body intermediate the inlet end and the outlet end, the collar having an outer surface and at least one aperture formed therein, wherein the outer surface abuts the inner surface of the chamber to form a substantially fluid-tight seal therebetween, and wherein the at least one aperture facilitates a separation of a liquid from a fluid.

2. The fluid separator according to claim 1, wherein the at least one aperture is formed in the collar to extend diagonally therethrough.

3. The fluid separator according to claim 1, wherein the at least one aperture attenuates pressure pulsations caused by a compression of the fluid.

4. The fluid separator according to claim 1, wherein the fluid is a refrigerant and the liquid is an oil.

5. The fluid separator according to claim 1, further comprising an annular array of apertures formed in the collar.

6. The fluid separator according to claim 1, wherein the hollow main body, the flange, and the collar are produced from at least one of a metal material and a plastic material.

7. A compressor comprising:

a housing including a chamber formed therein, the chamber having an inner surface; and a fluid separator disposed in the chamber, the fluid separator further comprising:

a hollow main body including an inlet end and an outlet end;

an annular flange formed on the outlet end of the hollow main body, the annular flange having an outer surface, wherein the outer surface abuts the inner surface of the chamber to form a substantially fluid-tight seal therebetween; and an annular collar formed on the hollow main body intermediate the inlet end and the outlet end, the annular collar having an outer surface and an annular array of apertures formed therein, wherein the outer surface abuts the inner surface of the chamber to form a substantially fluid-tight seal therebetween, and wherein the apertures separate a liquid from a fluid.

8. The compressor according to claim 7, wherein the chamber includes an inlet, a first outlet, and a second outlet.

9. The compressor according to claim 7, wherein the fluid separator divides the chamber into a first sub-chamber, a second sub-chamber; and a third sub-chamber.

10. The compressor according to claim 9, wherein the hollow main body facilitates a flow of the fluid from the third sub-chamber to the first sub-chamber.

11. The compressor according to claim 7, wherein the chamber formed in the housing attenuates pressure pulsations caused by a compression of the fluid.

12. The compressor according to claim 7, wherein the apertures formed in the annular collar attenuate pressure pulsations caused by a compression of the fluid.

13. The compressor according to claim 7, wherein the fluid is a refrigerant and the liquid is an oil.

14. The compressor according to claim 7, wherein the chamber includes a screen.

15. The compressor according to claim 7, wherein the fluid separator is produced from at least one of a metal material and a plastic material.

16. A hybrid compressor comprising:

a housing forming a hollow interior, the housing including a chamber having an inner surface, wherein the chamber includes an inlet, a first outlet, and a second outlet;

a plurality of compression assemblies disposed in the hollow interior of the housing, one of the compression assemblies driven by a mechanical source, and another of the compression assemblies driven by an electrical source; and an oil separator disposed in the chamber, wherein the oil separator divides the chamber into a first sub-chamber, a second sub-chamber, and a third sub-chamber, wherein the first sub-chamber is in fluid communication with the first outlet and the third sub-chamber, the second sub-chamber is in fluid communication with the inlet and the third sub-chamber, and the third sub-chamber is in fluid communication with the second sub-chamber and the second outlet, the oil separator further comprising:

a hollow main body including an inlet end and an outlet end, wherein the hollow main body facilitates a flow of a refrigerant from the third sub-chamber to the first sub-chamber;

an annular flange formed on the outlet end of the hollow main body, the annular flange having an outer surface, wherein the outer surface abuts the inner surface of the chamber to form a substantially fluid-tight seal therebetween; and an annular collar formed on the hollow main body intermediate the inlet end and the outlet end, the annular collar having an outer surface and an annular array of apertures formed therein, wherein the outer surface abuts the inner surface of the chamber to form a substantially fluid-tight seal therebetween, and wherein the apertures separate an oil from a refrigerant.

17. The hybrid compressor according to claim 16, wherein at least one of the first sub-chamber, the second sub-chamber, and the third sub-chamber attenuates pressure pulsations caused by a compression of the refrigerant.

18. The hybrid compressor according to claim 16, wherein the apertures formed in the annular collar attenuate pressure pulsations caused by a compression of the refrigerant.

19. The hybrid compressor according to claim 16, wherein the second outlet of the chamber includes a screen.

20. The hybrid compressor according to claim 16, wherein the oil separator is produced from at least one of a metal material and a plastic material.

* * * * *